343-872 SR
1/22/80 XR 4,185,287

United States Patent [19]
Hubing et al.

[11] 4,185,287
[45] Jan. 22, 1980

[54] MECHANICALLY SCANNED ANTENNA SYSTEM

[75] Inventors: James H. Hubing, Richardson; Charles C. Liu, Dallas, both of Tex.

[73] Assignee: Texas Instruments Incorporated, Dallas, Tex.

[21] Appl. No.: 818,474

[22] Filed: Jul. 25, 1977

[51] Int. Cl.[2] ..... H01Q 3/12
[52] U.S. Cl. ..... 343/761; 333/252; 343/779; 343/872; 333/259
[58] Field of Search ..... 333/98 S; 343/761, 779, 343/872, 839, 854

[56] References Cited

U.S. PATENT DOCUMENTS

| | | | |
|---|---|---|---|
| 3,179,905 | 4/1965 | Ward | 333/98 S |
| 3,568,207 | 3/1971 | Boyns et al. | 343/854 |
| 3,852,762 | 12/1974 | Henf et al. | 343/761 |
| 3,953,857 | 4/1976 | Jenks | 343/854 |
| 4,020,491 | 4/1977 | Bieser et al. | 343/765 |

*Primary Examiner*—Eli Lieberman
*Attorney, Agent, or Firm*—Rene' Grossman; James T. Comfort; Alva H. Bandy

[57] ABSTRACT

A mechanically scanned antenna system having a multiport rotary switch for sector scanning is disclosed. The switch includes a stationary subassembly and a rotating subassembly. The stationary subassembly contains the input ports and the rotating subassembly contains the multiple output ports associated with each input port. Each of the multiple output ports of the switch is sequentially activated through its designed active sector to produce the desired antenna scan pattern. The stationary subassembly includes a barrier member which is rotatable to selectively orient and maintain orientation of the active region of the antenna system at any position through 360°.

7 Claims, 10 Drawing Figures

46
120
112
114
0°
ROTATION
87
150
95
ACTIVE
OUTPUT
118
96
116

46
120

118
112
22.5°
ROTATION
87
95
114
96
ACTIVE
OUTPUT
116

46

118
45°
ROTATION
120
87
95
112
96
116
114
SWITCH MECHANISM AT
0°, 22.5°, 45° ROTATION
ACTIVE
OUTPUT

MECHANICALLY SCANNED ANTENNA SYSTEM

This invention relates to an improved mechanically scanned antenna, and more particularly, to a sector scanning antenna system including a multiple port rotary switch having an internal electrically controlled active region adjusting and stabilizing mechanism.

In the past, mechanically scanned antennas using rotary switches to meet the requirement for rapid scanning of a sector have been mounted on large heavy-duty platforms requiring large servo motors to maintain the antenna radar support platforms stable when subjected to pitch and roll movements of the antenna carrier. The designs for high speed waveguide switches all have their problems. For example, the four-way "turnstile" waveguide switch, as described by J. S. Hollis and M. W. Long in an *IRE Transactions on Antennas and Propagation* article entitled "A Luneberg Lens Scanning System" (January 1957, pp. 21–25), which is an old and proven design, suffers from very narrow bandwidth capability (about 2 percent). Also, a "ring" switch described by Peeler and Gabriel in *IRE Convention Record* entitled "Volumetric Scanning GCA Antenna" (Part L, 1955, pp. 20–27) is an intricate mechanism making use of a split and choked ring of waveguide and multiple rows of waveguide shorting pins. The ring switch is difficult to produce and offers a very difficult pressure-sealing problem for use in an environment requiring pressure-sealing. Electrically, the switch has about a 10 percent bandwidth but suffers from isolation problems between the active output and the remaining pin shorted output arms. All of these known systems suffer from large rotating mass/inertia problems.

Accordingly, it is an object of this invention to provide a mechanically scanned antenna system having a high-speed waveguide switch assembly which is simple in design, light weight, very reliable, and easy to manufacture and maintain.

Another object of the invention is to improve the bandwidth capability of the multiple port rotary switch.

Still another object of the invention is to eliminate the need for large, heavy-duty stabilization mechanisms for a mechanically scanned antenna system.

Another object is to provide a mechanically scanned antenna system capable of easy adjustment for desired sector scanning.

Briefly stated the invention comprises a mechanically scanned antenna including a multiport rotary switch which has a built in stabilization mechanism to replace the expensive, heavy-duty, pitch/roll stabilized platforms used to support the total weight of other mechanically scanned radar antennas.

The novel features believed to be characteristic of this invention are set forth in the appended claims. The invention itself, however, as well as other objects and advantages thereof may best be understood by reference to the following detailed description of an illustrative embodiment when read in conjunction with the accompanying drawings in which:

FIG. 1 is a plan view of a parabolic torus transreflector antenna configuration with portions broken away to disclose the scanner assembly of the invention including the multiport rotary switch;

FIG. 2*a* is a fragmentary view, partly in elevation, of the rotary switch;

FIG. 2*b* is a cross-sectional view of the dual channel multiport rotary switch configuration of the parabolic torus transreflector antenna taken along line A—A in FIG. 2*a*;

Figure 3:
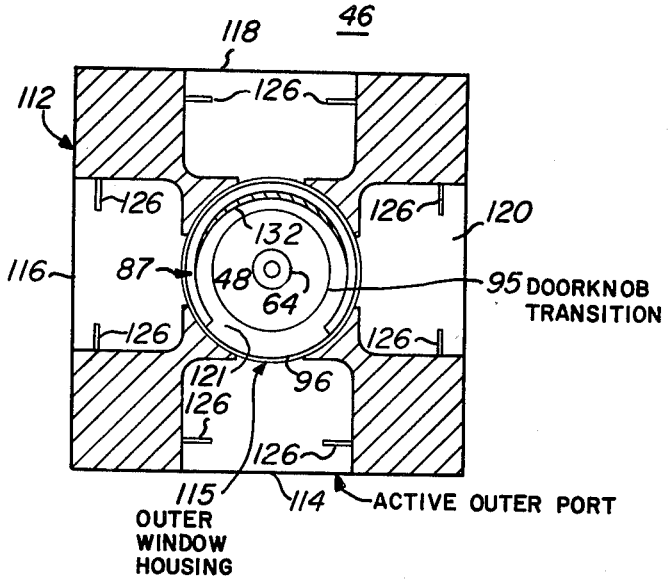
FIG. 3 is a cross-sectional view taken along line B—B in FIG. 2*a* of the high power (Σ) channel switch mechanism.
Figure 5A:
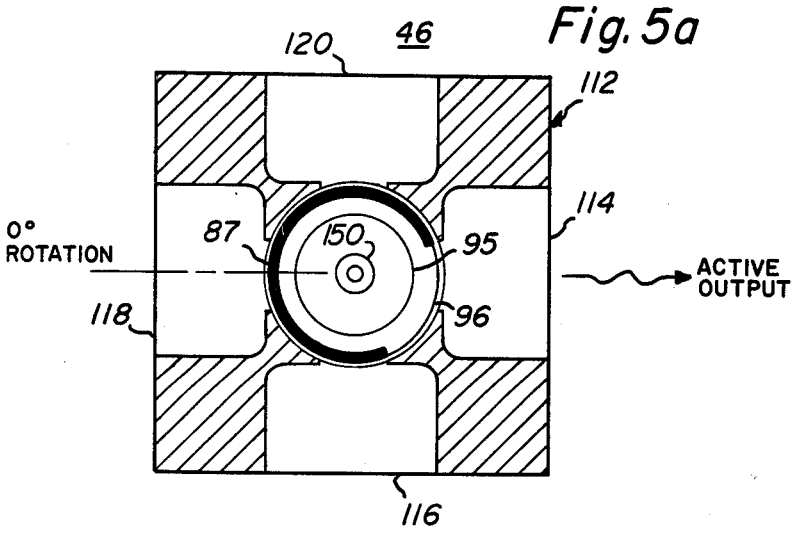
Figure 5B:
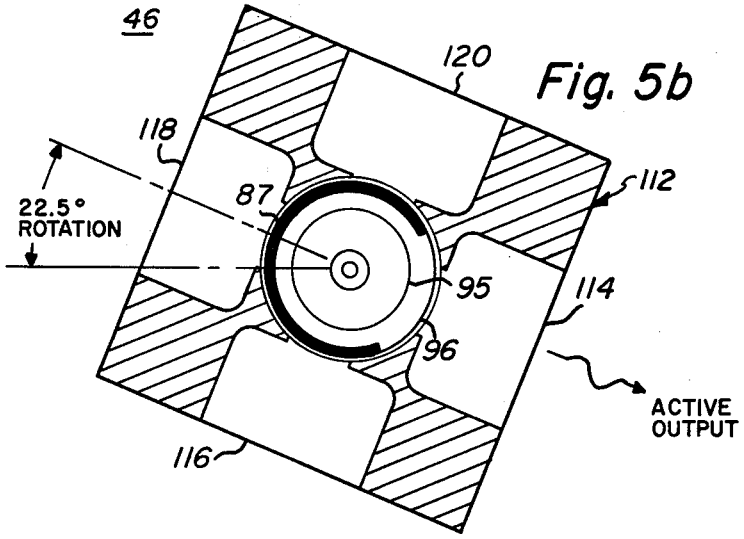
Figure 5C:
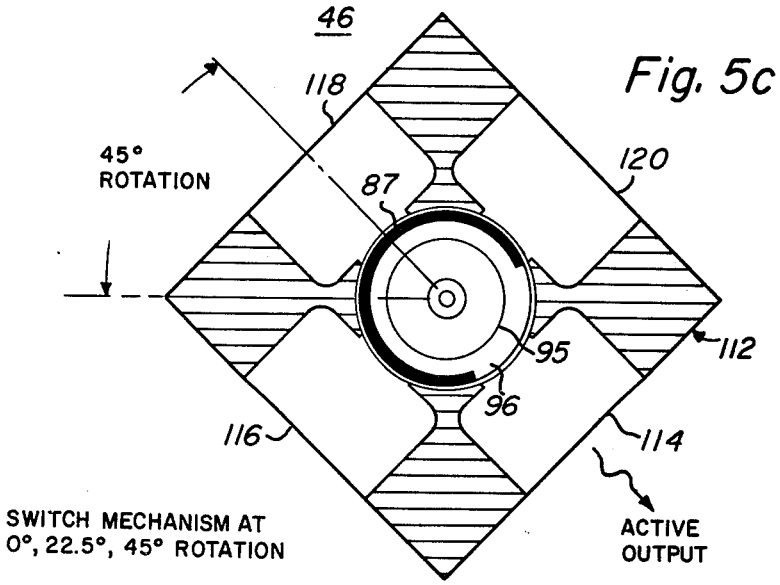
Figure 6:
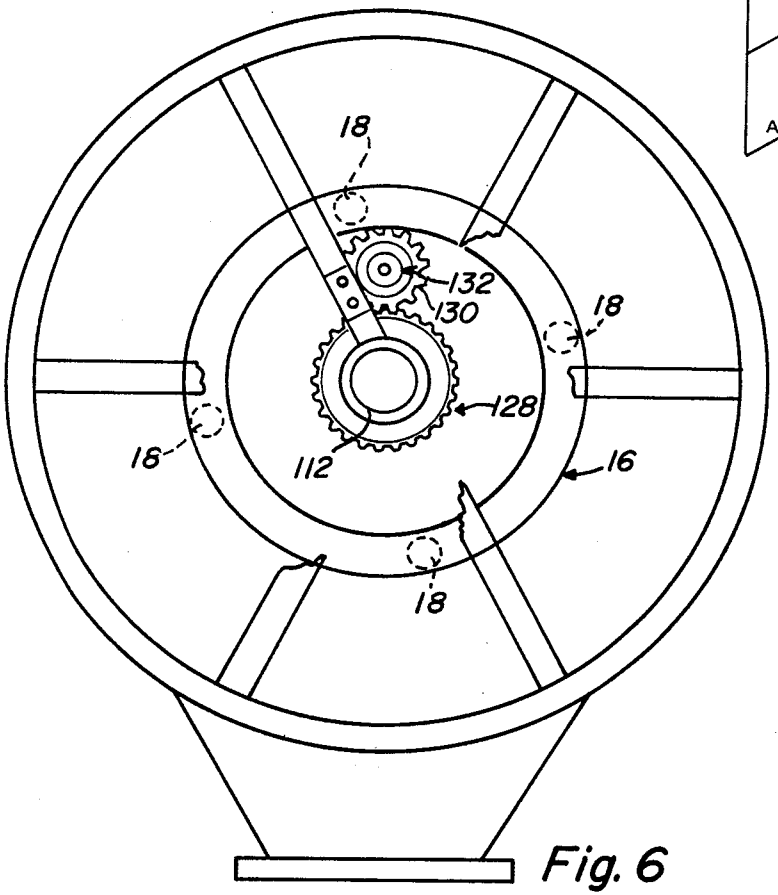

FIGS. 5*a*, 5*b* and 5*c* are views of the cross-sectional view of FIG. 3 showing the position of the rotary switch at the beginning, middle and end of the 45° active scan sector designed into this switch;

FIG. 6 is a rear view of the scanner assembly; and

Figure 7:
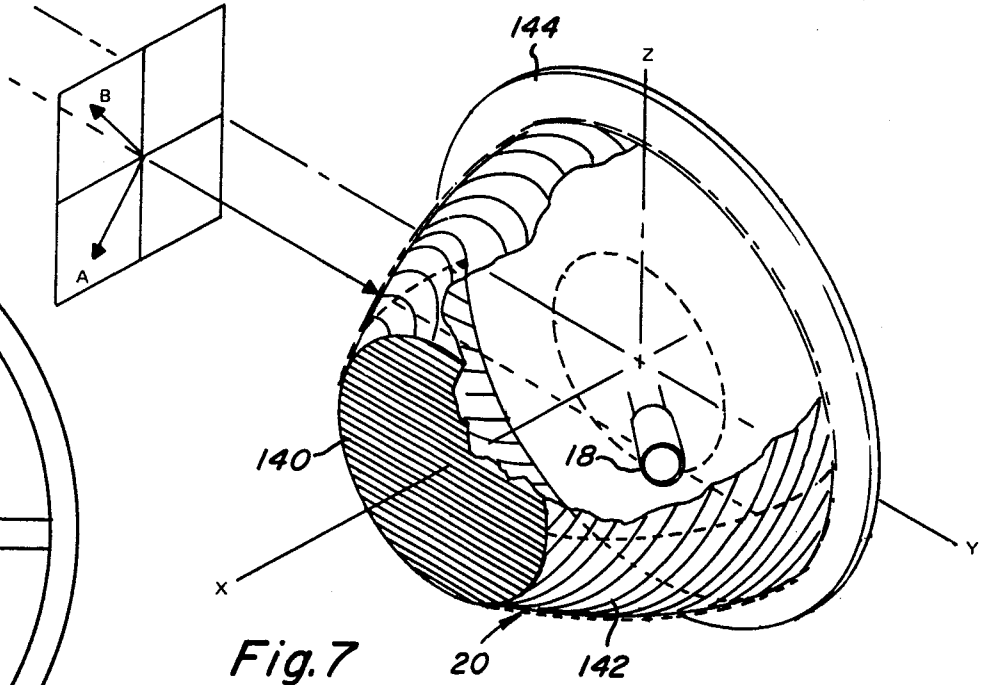

FIG. 7 is a plan view, partly cut away and partly in cross section, of the parabolic torus transreflector antenna.

Figure 1:
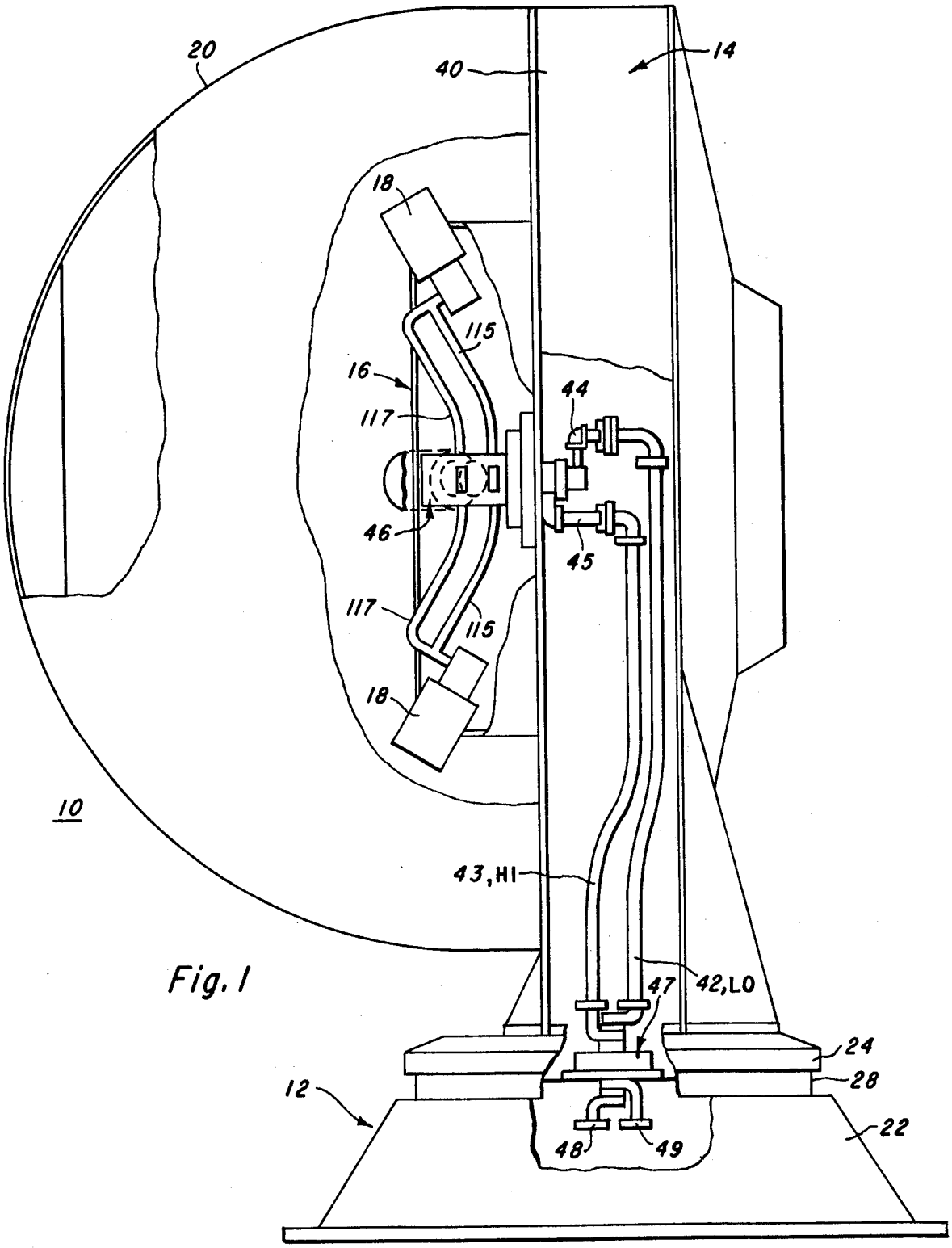

Referring now to the drawings, for the purpose of description only the invention is taught in connection with a parabolic torus transreflector antenna system 10 (FIG. 1). This system comprises an azimuth scanning pedestal 12, a supporting structure 14 attached to the scanning pedestal 12, a scanner assembly 16 fastened to the supporting structure including a subassembly of corrugated feedhorns 18, and a transreflector 20. The azimuth scanning pedestal 12 includes a base support member 22 upon which is rotatedly mounted an azimuth platform 24. The azimuth platform 24 has the supporting structure 14 rigidly attached thereto. The azimuth platform is rotatably mounted on the base support member 22. A ring gear (not shown) is attached to the inner surface of depending annular flange 28, and is driven in azimuth by a motor (not shown) mounted within the pedestal 12. The azimuth platform 24, depending flange 28, and base structure 22 coact to protect the azimuth drive mechanism from the outside environment.

The supporting structure 14 includes a circular ring member 40 rigidly attached to the azimuth platform 24. The ring member 40 supports the scanner assembly 16, waveguides 42 and 43, and transreflector 20. The waveguides 42 and 43 are, respectively, a low power channel (difference channel) and a high power input channel (sum channel) having upper ends connected to corresponding waveguides 44 and 45 of the rotary switch 46. The lower ends of channels 42 and 43 are connected to a rotary joint 47 which receives power from and transmits power to the radar receiver and transmitter (not shown) through waveguides 48 and 49. The rotating portion of the rotary joint is attached to the ring member 40 and the stationary portion is attached to the base support member 22.

Figure 2A:
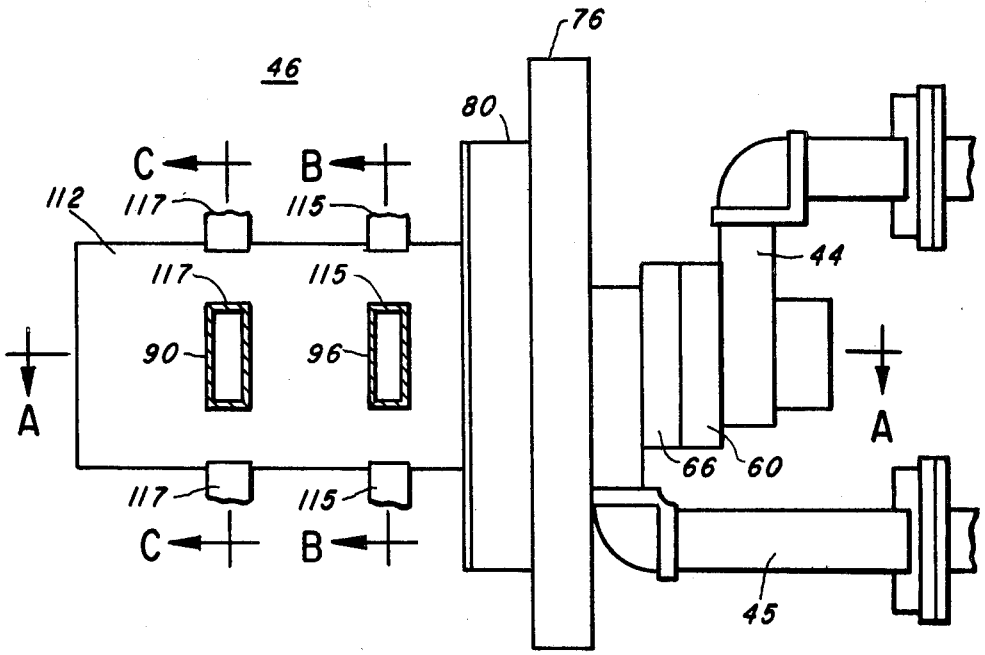
Figure 2B:
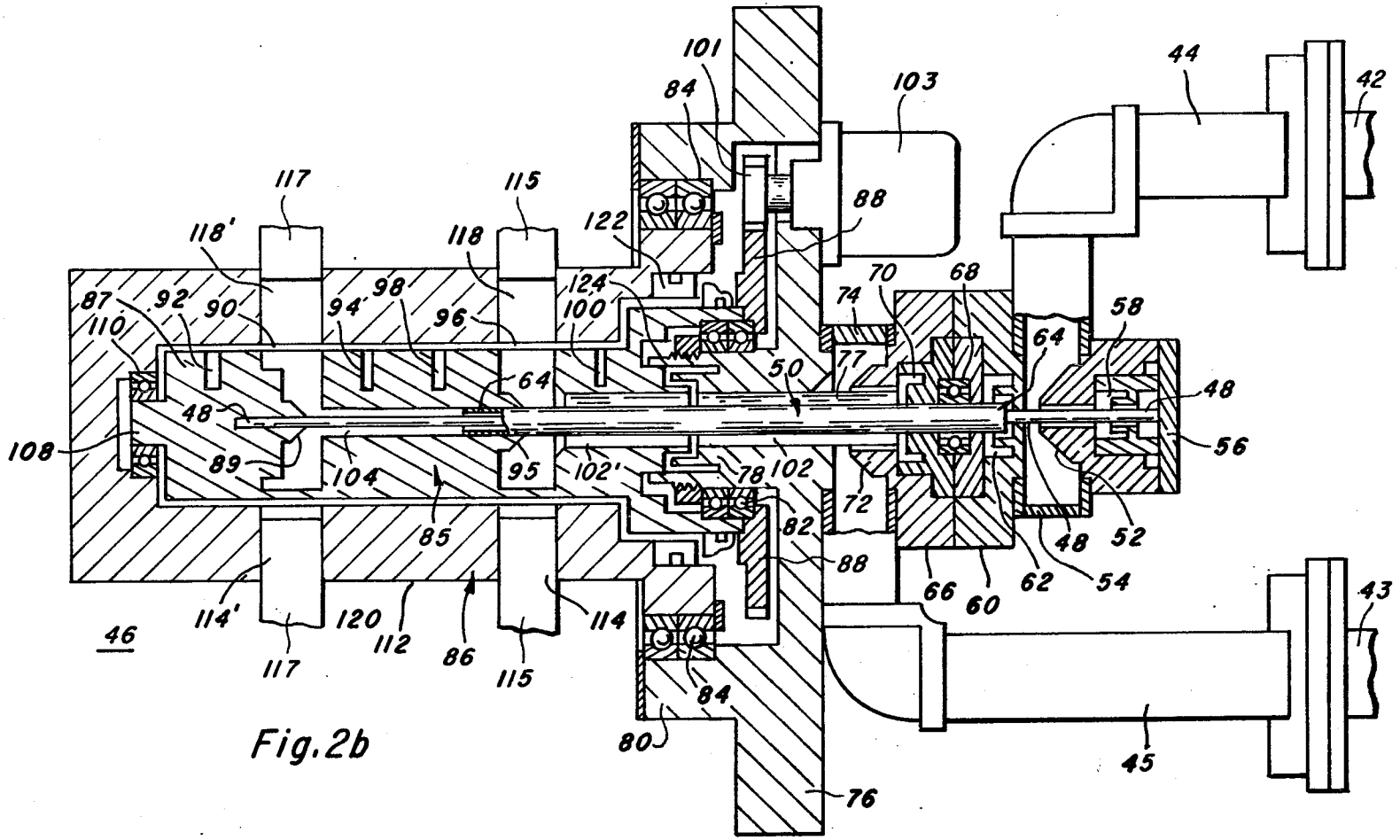

Referring now to FIGS. 2*a* and 2*b*, the rotary switch 46 of the scanner assembly 16 includes the low power channel waveguide 44 (FIG. 2*a*) and the high power channel waveguide 45. Waveguide 44 transitions into the inner coaxial path 104 (FIG. 2*b*). The RF energy in the rectangular waveguide 44 is conducted in the dominant mode ($TE_{10}$) and is converted to the dominant (TEM) mode in the coaxial cable 50 by a "doorknob" transition 52. The "doorknob" transition is preferred because it produces the most compact switch length and because it permits the two channels of the switch to be constructed with concentric coaxial transmission paths through the central portion of the switch. The "doorknob" transition 52 is adjacent to a radiused tuning insert 54. The doorknob transition contain· an RF choke 58 to maintain electrical continuity between the stationary doorknob 52 and the rotating center conductor 48. A dielectric bushing 56 is positioned beneath the choke to properly position the center conductor 48 in the center of the choke.

An annular block 60 is attached to waveguide 44 above the doorknob transition. The block 60 has a choke 62 formed therein which surrounds the end of the outer conductor 64 of the coaxial cable 50. The choke 62 prevents RF energy from escaping along the outside of the outer conductor 64. Thus, the RF energy of the low power channel is transmitted through the space between the inner 48 and outer 64 conductors of the coaxial cable 50. The block 60 coacts with an annular block 66 to house a seat for bearing 68. Bearing 68 permits rotation of the coaxial cable 50 within the blocks 60 and 66. Block 66 also has a choke 70 formed therein to prevent RF energy from the high power channel escaping through the coaxial cable opening in block 66.

The waveguide 45 of the high power channel transitions into the outer coaxial path 102. The RF energy in the rectangular waveguide 45 is conducted in the dominant mode ($TE_{10}$) and is converted to the dominant (TEM) mode in the coaxial cable by a "doorknob" transition 72, along with a flat tuning insert 74 in waveguide 45.

An annular stationary housing 76 is attached to the waveguide 45 with the coaxial cable 50 passing through a centrally disposed passage 77. The stationary housing 76 is a large annular disk having an upwardly extending, centrally disposed collar 78 through which the coaxial cable 50 passes, and an upwardly extending flange 80 adjacent the outer edge of the annular disk 76. The collar 78 and upwardly extending flange 80 support bearings 82 and 84, respectively.

The rotary switch 46 includes a stationary subassembly 85 and a rotating subassembly 86. The stationary subassembly includes a rotatable switch barrier 87 having an outwardly extending drive gear 88 formed at one end, a first symmetrical coax-to-waveguide "doorknob" transition 89 adjacent a low power channel output window 90 intermediate chokes 92 and 94, and a second symmetrical coax-to-waveguide "doorknob" transition 95 adjacent a high power channel window 96 formed intermediate chokes 98 and 100. The rotatable switch barrier 87 is mounted on bearing 82. A pinion gear 101 meshes with the switch barrier drive gear 88 and is driven by a servo motor 101 attached to the stationary housing 76. The rotatable switch barrier 87 forms extensions of the two concentric coaxial paths 102 and 104. The inner concentric coaxial path 104 is defined by the inner conductor 48, portions of the outer conductor 64 of coaxial cable 50 and inner wall of the rotatable switch barrier which forms an uninterrupted extension of the outer conductor 64. The outer conductor 64 of the coaxial cable 50 forms the inner conductor of the concentric coaxial path 102 and its outer conductor is formed by the inner walls of the stationary housing 76 and the portion of the inner wall of the rotatable switch barrier 87 below the window 96. The inner conductor 48 is anchored in the upper end of the rotatable switch barrier 87. The rotatable switch barrier 87 has its upper end 108 journaled in bearing 110 of a rotating outer housing 112 of the rotating subassembly 86.

The rotating housing 112 of the rotating subassembly 86 has in addition to the bearing 110 a plurality of apertures 114, 116, 118 and 120 (FIG. 3) in planar alignment with the high power channel window 96 (FIG. 2*b*) of the rotatable switch barrier 87 of the stationary subassembly 85, and a plurality of apertures 114', 116', 118', and 120' (FIG. 4) in planar alignment with the low power channel window 90 (FIG. 2) of the rotatable switch barrier 87. The outer housing 112 is mounted on bearing 84 of the stationary housing 76. A carbon face seal 122, attached to the outer housing 112, seals the area between the outer housing 112 and the rotatable switch barrier 87. The seal uses magnetic force supplied by a magnetized ring to maintain proper pressure between the sealing surface and the carbon face. A teflon-graphite lip seal 124 is used between the stationary housing 76 and the rotatable switch barrier 87.

Referring now to FIG. 3, a relationship of the rotatable switch barrier 87 to the rotating outer housing 112 at the high power channel ports 114, 116, 118 and 120 is shown. The view shows the rotating outer housing in the middle of its active scan sector. Preferably the rotating outer housing ports 114, 116, 118 and 120 are at 90° one to the other. The switch window 96 width in the switch barrier 87, the $TEM/TE_{10}$ transition cavity diameter 121, and the switch window width 115 in the outer housing 112 at the switching junction are adjusted to obtain the desired unobstructed output sector angle. The choice of dimensions here also determines the switching dead time, which is the time required for the switch to rotate from the end of the unobstructed output arm sector to the beginning of the next unobstructed output arm sector. With the desired 45° active scan sector in the embodied antenna system the minimum window size 96 in the barrier becomes a cutout of 90° and the minimum window 115 in the outer housing becomes a 45° cutout. This configuration yields a 45° active scan sector where from the beginning of the active sector, 0° scan, to the end of the active sector, 45° scan, there is no reduction in the window size of the outer housing due to overlap of the barrier window 96. The resultant constant switch window opening into the output ports throughout the active scan sector insures minimal variation of the RF transmission characteristics of the switch as it is rotated.

Figure 4:
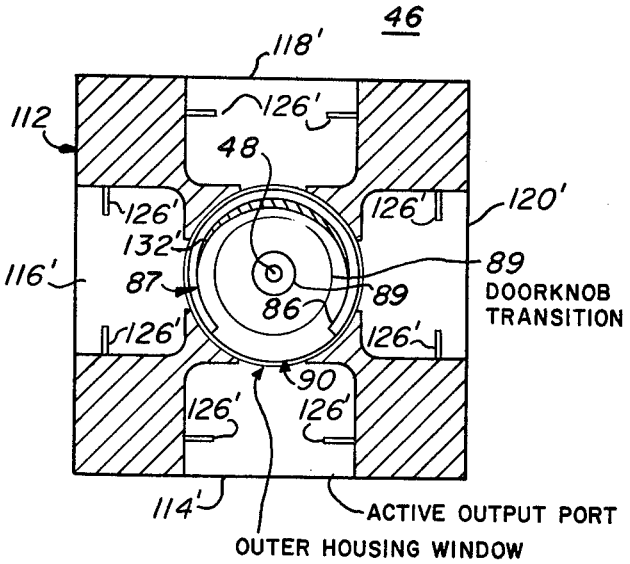
FIG. 4 is a cross-sectional view taken along line C—C in FIG. 2*a* of the low power (Δ) channel switch mechanism.

FIG. 4 shows the relationship of the rotatable switch barrier 86 and the rotating outer housing 112 at the low power channel port. The structure here is substantially that shown for the high power channel section (FIG. 3). In the low and high power channels RF chokes (see FIG. 2) 92 and 94, and 98 and 100, respectively, have, been placed between the switch barrier 86 and the rotating outer housing 112 to provide electrical continuity to the transmission path.

FIG. 5*a* illustrates the rotating outer housing 112 of the rotary switch at the beginning or 0° rotation position of the 45° active scan sector, FIG. 5*b* shows the rotary housing 112 at the mid scan or 22.5° position, and FIG. 5*c* shows the rotating housing 112 at the end or 45° rotation position of the 45° active scan sector. It will be noted that the window 96 at the beginning of the 45° active scan sector extends from the beginning of one port 114 to the beginning of an adjacent port 116 and that at the end of the 45° active scan sector the beginning of the window 96 is at the end of port 120 and extends to the end of the adjacent port 114. The switch if turned further would reach port 120 output arm unobstructed sector after approximately 45° of rotational dead time.

With the window sizes determined as indicated previously the electrical tuning of the switching mechanism is accomplished by adjusting the doorknob transitions 89 and 95 (FIGS. 3 and 4) in the barrier member 87 and proper selection of the inductive tuning irises 126 in the ports of the outer housing 112. The irises compensate for the high inductive impedance of the window structure and are used to fine tune the VSWR of the multiport rotary switch 46. A polar display of admittance coordinates for the switching mechanism is used to facilitate selection of the proper tuning irises.

The switch 46 can be used while the switching action is taking place; however, there would be RF leakage between arms, and the VSWR of the switch would deteriorate. In this preferred embodiment, the power level and VSWR requirements make it necessary to turn off the transmitter during the switching action. The switch can be used over the entire waveguide band of frequencies since it contains no resonant or narrow band structures in its design.

The scanning assembly 16 (FIG. 1) further includes a corrugated feedhorn 18 mounted on a rotatable supporting member 16 (FIG. 6) for each pair of corresponding ports of the rotating outer housing 112 to which it is rigidly attached. Each pair of parts consists of a sum channel (high power) port and a corresponding difference channel (low power) port, for example, a 114 port connected, respectively, by waveguides 115 and 117 to feedhorns 18 (FIG. 1), and a 114' port. A drive gear 128 (FIG. 6) is attached to the corrugated feedhorn rotatable support member 16 which meshes with pinion gear 130. Pinion gear 130 is mounted on the drive shaft of servo motor 132. The servo motor rotates corrugated feedhorn support member 16 and the outer housing 112. A cylindrical corrugated waveguide horn or conical corrugated horn has been used for the feed system for parabola reflectors. Such a feed system is actually asymmetric with very low cross polarization response and may be shaped for high efficiency low noise operation by suitable choice of hybrid modes. The feedhorn 18 is a multimode corrugated feedhorn. The corrugations are either machined or constructed of sheet metal plates dip brazed or bonded together to form the combined structure. The outer walls of the feedhorn are at a minimum thickness to minimize weight and a thin dielectric cover is attached to the front of the feedhorn to prevent contaminants from collecting on the internal corrugations. The waveguide parts are standard X-band waveguide dip brazed to the rear portion of the feedhorn. In this type horn, when the TM and TE components are in phase, there is maximum radiation along the feed axis, and when the two components are out of phase there is a null along the feed axis. This permits the use of a reflector with a single multimode corrugated horn which is much more efficient than using multihorn feed.

Referring now to FIG. 7, the transreflector 20 of the parabolic torus transreflector antenna comprises a honeycomb sandwich absorber portion 140 located at the apex of the antenna, a transreflection area 142 adjacent to and integral with the absorber and a mounting bracket 144 attached to the transreflection area. The integrated honeycomb sandwich 140 absorber is a honeycomb structure having a rounded end for extra shell strength and coated with an epoxy fiberglass. A resistive sheet is applied to the epoxy coating. The absorber is to prevent lobes on the azimuth approximately 90° from the main lobe. The transreflection area 142 is generated by rotating a section of parabolic arc 360° about an axis parallel to the latus rectum. The transreflection area is formed of a dome shaped wire grid with a 45° orientation of the grid element. The grid is an integral part of the radome. Projections of the wire grids from opposite surfaces under any plane containing the torus axis are perpendicular. However, for a half parabolic torus antenna with an offset feedhorn, the area of most intense feed illumination is about half the height of the dome. The grid wires are required to be oriented at 48° to achieve orthogonal projection characteristics. The use of a 48° linearly polarized feedhorn 18 enables the grid surface to be a reflector for energy transmitted from the feedhorn which strikes the grid and then is transparent to the energy traveling across the interior of the dome. Since the transreflector dome is circular and, therefore, symmetrical in one plane, the feed and resulting beam can be scanned through 360° continuously in elevation. The mounting bracket 144 is attached to the mounting ring structure 14 which is closed by a back cover 146 having a centrally disposed wind baffle plate 148 (FIG. 1).

In operation, RF energy is fed intermittently through the high power (Σ) rectangular waveguide 48, 43, and 45 (FIG. 1). The high power energy passes through waveguide 45 into the doorknob transition 72 (FIG. 26) where it is reflected along the outer path 102 through the window 96 of the rotatable switch barrier and sequentially through ports 114, 116, 118, and 120 of the rotating outer housing 112 where it is radiated through waveguide 115 to the plurality of corrugated feedhorns (FIG. 1). As only one horn couples to the switch window and receives energy at any given time, only one scanning beam exists at a time. However, as the corrugated feedhorn support member rotates about the window 96, the horns attached to ports 114, 116, 118 and 120 scan a pattern from 0° to 45°. As the radar antenna carrier, which may be, for example, either a ship or aircraft or other moving vehicle, is subject to pitch and roll movements, the 0° to 45° scan pattern wobbles accordingly about the horizon. This wobble effect is removed and the 0° to 45° scan pattern oriented to the horizon by rotating the rotatable switch barrier 87 of the stationary subassembly of the rotary switch 46 to continually adjust its window 96 in response to electrical signals indicative of the pitch and roll movements of the carrier. The capability of the rotatable switch barrier 87 of the rotary switch to adjustably compensate for pitch and roll movements of the radar antenna carrier, as previously stated, eliminates the need for complex and expensive mechanical stabilization systems.

Similarly, the low power rectangular waveguide 49, 42 and 44 (FIG. 1) (difference channel) receives the reflected low power RF energy from the doorknob transition 52 (FIG. **2*b*). The transition 52 receives the energy from the inner path 104, window 90 of the rotatable switch barrier 87, rotating outer housing ports 114', 116', 118', and 120', waveguides 117 and corrugated feedhorns 18 attached thereto. The reflected RF energy passes from one side of the reflector to the other side where it is reflected by the 45° conducting wires through the feedhorn 18** in line with the reflecting wires and in front of the switch window. Energy reflected from a target is passed to the radar receiver for processing.

Although only a single embodiment of this invention has been described herein, it will be apparent to a person skilled in the art that various modifications to the details of construction shown and described may be made without departing from the scope of t' 's invention.

What is claimed is:

1. A mechanically scanned antenna system comprising:

(a) an antenna support means; and (b) an antenna scanning means being supported by the antenna support means; said antenna scanning means including:

(i) an RF power channel means for conducting RF energy to and from a radar receiver and transmitter, (ii) a rotary switch having an input means and an output means, said input means being in RF energy conducting communication with the RF power channel means, and said output means being mounted on the input means with which it coacts for switching RF energy;

(iii) orientation means being operatively connected to the input means of the rotary switch for continuously orienting the input means to a preselected reference point, (iv) a plurality of feedhorns being rigidly attached to the output means of the rotary switch in RF power communication with the output means, (v) a rotatable support means supporting the plurality of feedhorns and rotatably connected to the antenna support means, and (vi) a drive means being attached to the antenna support means for rotating the rotatable support means, and the plurality of feedhorns, together with the output means of the rotary switch about the input means of the rotary switch for producing a preselected scanning pattern.

2. A mechanically scanned antenna system according to claim 1 wherein the antenna scanning means further includes a transreflector radar antenna radome having a preselected absorber area and a transreflection area, said transflection area being integral with the absorber area, and a mounting bracket attaching the radome to the antenna support means in operative association with the plurality of feedhorns of the antenna scanning means.

3. A mechanically scanned antenna system according to claim 1 wherein the antenna support means includes an azimuth scanning pedestal having a stationary member and a rotatable member said rotatable member being rotatably mounted on the stationary member, an RF rotary joint having a stationary portion being connected to the stationary member of the pedestal and a movable portion being attached to the rotatable member of the pedestal for coupling RF energy to the RF power channel means, and an antenna support member being rigidly attached to the rotatable member of the pedestal for supporting the scanner assembly.

4. A mechanically scanned antenna system according to claim 1 wherein the RF power channel means of the antenna scanning means includes a sum channel and a difference channel for receiving, respectively, sum and difference signals, said channels including a first waveguide, which is for the difference channel, a tuner being inserted at an end of the waveguide, a transition member being positioned in the first waveguide adjacent the tuner, a coaxial cable having its inner conductor centrally disposed through the transition member and extending within the outer conductor substantially through the input means of the rotary switch and its outer conductor having one end adjacent the first waveguide and its opposite end terminating within the input means of the rotary switch, a block being connected to the first waveguide and having a centrally disposed passage through which the coaxial cable is rotatably mounted, a second waveguide, which is for the sum channel, being connected to the block, a tuner being inserted at an end of the second waveguide, a transition member being positioned in the second waveguide adjacent the tuner, said coaxial cable extending through the central portion of the transition member with its outer conductor forming the inner conductor of a second coaxial cable terminating within the second waveguide, and a stationary housing being connected to the second waveguide and having a centrally disposed passage whose walls form a portion of the outer conductor of the second coaxial cable, whereby RF energy in the sum and difference channels is conducted in the dominant mode ($TE_{10}$) in the first and second waveguides and in the dominant mode (TEM) in the first and second coaxial cables.

5. A mechanically scanned antenna system according to claim 1 wherein the input means of the rotary scanner includes a switch barrier having one end being rotatably mounted on the RF power channel means and an opposite end being rotatably mounted in the output means, first and second passages being formed in axial alignment within said switch barrier, the walls of said first passage being a portion of the outer conductor of a first coaxial cable and the walls of said second passage being a part of a portion of the outer conductor of a second coaxial cable, the inner conductor of the first coaxial cable forming a part of a portion of the outer conductor of the second coaxial cable, first and second waveguide portions being formed transversely to the first and second coaxial cables and in a spaced relationship to each other, transition members being centrally disposed on faces of the first and second waveguide portions, said first and second coaxial cables being in RF power communication, respectively, with the first and second waveguide portions, first and second windows being formed in the periphery of the switch barrier, said windows being in alignment and in communication, respectively, with the first and second waveguide portions, and a plurality of chokes being adjacent sides of the first and second windows for preventing loss of RF energy between the input means and the output means.

6. A mechanically scanned antenna system according to claim 5 wherein the output means includes a housing being rotatably mounted on the RF power channel means and enclosing substantially the switch barrier of the rotary switch, said housing having two spaced sets of windows each set being radially aligned with a corresponding window of the switch barrier, and a plurality of feedhorns, each feedhorn of said plurality of feedhorns being connected to corresponding windows of the two sets of windows.

7. A mechanically scanned antenna system according to claim 4 wherein the stationary housing of the RF power channel means includes a centrally disposed collar, the orientation means for continuously orienting the input means includes a servo motor being attached to the stationary housing and a drive means being connected to the servo-motor, and the input means of the rotary switch includes a switch barrier, one end of said switch barrier being rotatably mounted on the centrally disposed collar and having a corresponding drive means being operative in response to the drive means of the orientation means for rotating the switch barrier in response to orienting signals for continuously orienting the switch barrier to a selected reference point.

* * * * *